United States Patent [19]

Wang et al.

[11] 4,207,178

[45] Jun. 10, 1980

[54] PROCESS FOR BENEFICIATION OF PHOSPHATE AND IRON ORES

[75] Inventors: Samuel S. Wang, Cheshire; Eugene L. Smith, Jr., Milford, both of Conn.

[73] Assignee: American Cyanamid Company, Stamford, Conn.

[21] Appl. No.: 955,868

[22] Filed: Oct. 30, 1978

Related U.S. Application Data

[63] Continuation-in-part of Ser. No. 863,031, Dec. 21, 1977, abandoned.

[51] Int. Cl.[2] ..... B03D 1/02

[52] U.S. Cl. ..... 209/166

[58] Field of Search ..... 209/106, 167; 252/61

[56] References Cited

U.S. PATENT DOCUMENTS

| | | | |
|---|---|---|---|
| 2,236,528 | 4/1941 | Epstein | 209/166 X |
| 3,102,856 | 9/1963 | Chase | 209/166 |
| 3,256,140 | 6/1966 | Poschmann | 210/44 X |
| 3,915,391 | 10/1975 | Mercade | 209/166 X |

FOREIGN PATENT DOCUMENTS

| | | | |
|---|---|---|---|
| 659535 | 3/1963 | Canada | 209/160 |
| 914809 | 11/1972 | Canada | 209/166 |
| 584206 | 1/1947 | United Kingdom | 209/166 |
| 443682 | 9/1975 | U.S.S.R. | 209/5 |

*Primary Examiner*—Robert Halper

*Attorney, Agent, or Firm*—William J. vanLoo; Frank M. Van Riet

[57] ABSTRACT

Froth flotation of phosphate and iron ores is improved in recovery when a collector combination of a fatty acid and an alkylamidoalkyl monoester of a sulfosuccinic acid or a salt thereof is employed.

4 Claims, No Drawings

PROCESS FOR BENEFICIATION OF PHOSPHATE AND IRON ORES

CROSS-REFERENCE TO RELATED APPLICATION

This application is a continuation-in-part of Application Ser. No. 863,031, filed on Dec. 21, 1977 now abandoned.

This invention relates to an improved process for the beneficiation of phosphate and iron ores. More particularly, this invention relates to such a process wherein a collector combination of a fatty acid and an alkylamidoalkylaminoalkyl or an alkylamidoalkoxyalkyl monoester of a sulfosuccinic acid or salt thereof is employed.

Froth flotation is the principal means by which phosphate, hematite, magnetite and a host of other ores are concentrated. Its chief advantage lies in the fact that it is a relatively efficient process operating at substantially lower costs than many other processes.

Flotation is a process for separating finely ground valuable minerals from their associated gangue, or waste, or for separating valuable components one from another. In froth flotation, frothing occurs by introducing air into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Agents called collectors are used in conjunction with flotation to promote recovery of the desired material. The agents chosen must be capable of selectively coating the desired material in spite of the presence of many other mineral species. Current theory states that the flotation separation of one mineral species from another depends upon the relatively wettability of surfaces. Typically, the surface free energy is purportedly lowered by the adsorption of heteropolar surface-active agents. The hydrophobic coating thus provided acts in this explanation as a bridge so that the particle may be vttached to an air bubble. The practice of this invention is not, however, limited by this or other theories of flotation.

Phosphate rock is a typical example of phosphate and iron ores. Typically, phosphate ore containing 15–35% BPL[bone phosphate of lime, $Ca_3(PO_4)_2$] is concentrated in very large tonnages from the Florida pebble phosphate deposits. The ore slurry from strip mining is sized at about 1 millimeter and the coarser fraction, after scrubbing to break up mud balls, is a finished product. The minus 1 mm fraction is further sized at 35 and 200 mesh. The minus 200 mesh slime is discarded. From the sizing operation, the +35 mesh material in thick slurry is treated with fatty acid, fuel oil, and caustic, ammonia or other alkaline material and the resulting agglomerates are separated on shaking tables, spirals, or spray belts. The 35×200 mesh fraction is conditioned with the same type of reagents and floated by conventional froth flotation routes. Not all the silica gangue is rejected by the fatty acid flotation so the concentrate is blunged with acid to remove collector coatings, deslimed, washed free of reagents and subjected to an amine flotation with fuel oil at pH 7–8. This latter flotation, sometimes called "cleaning", removes additional silica and raises the final concentrate grade to 70–75% BPL.

Although the procedure described is effective in the beneficiation of phosphate and iron ores in general, there, nevertheless, exists the need for more effective collectors which provide increased recovery of phosphate and iron minerals while still providing high grade. It is particularly desirable to reduce the requirements for fatty acids which are increasingly being diverted to nutritional and other uses. In view of the high quantities of phosphate and iron minerals processed by froth flotation, such a development can result in a substantial increase in the total amount of mineral values recovered and provide substantial economic advantages even when a modest increase in recovery is provided. It is also highly desirable to have an efficient collector system for use at reduced dosage levels without sacrificing the mineral recovery performance. The decreases in reagent consumption are significant in view of the increasing diversion of fatty acids to nutritional and other uses. Accordingly, the provision for an improved process for beneficiating phosphate and iron minerals would fulfill a long-felt need and constitute a significant advance in the art.

In accordance with the present invention, there is provided a process for beneficiating phosphate and iron minerals which comprises classifying the mineral to provide particles of flotation size, slurrying the classified mineral in aqueous medium, conditioning the slurry with an effective amount of a collector combination and froth floating the desired mineral values, said collector combination comprising from about 1 to about 99 weight percent of a fatty acid derived from a vegetable or animal oil and, correspondingly, from about 99 to about 1 weight percent of an alkylamidoalkylaminoalkyl or an alkylamidoalkoxyalkyl monoester of sulfosuccinic acid of the general formula:

$$R-\overset{\overset{\displaystyle O}{\|}}{C}-NH\left(C_2H_4Y\right)_n\left(C_2H_4Z\right)_p\overset{\overset{\displaystyle O}{\|}}{C}-CH_2-\underset{\underset{\displaystyle SO_3^{(-)}X^{(+)}}{|}}{CH}-\overset{\overset{\displaystyle O}{\|}}{C}-O^{(-)}X^{(+)} \qquad \text{(I.)}$$

wherein R is a saturated or unsaturated alkyl radical of about 4 to 18 carbon atoms, Y is —NH— or —O—, n is an integer of from 1 to 10, inclusive, Z is —NH— or —O—, p is an integer of from 0 to 9, inclusive, such that the sum (n+p) never has a value greater than 10, and X is hydrogen, alkali metal ion or ammonium ion.

The process of the present invention by its use of the specified collector combination provides superior results in the froth flotation of phosphate and iron ores than obtained with either component alone and leads to high recovery and grade at lower dosage requirements. In preferred instances, fatty acid requirements can be reduced by 50% while still maintaining high mineral recovery and grade.

In carrying out the process of the present invention, a phosphate and iron mineral is selected for treatment. Such minerals include phosphate, hematite, magnetite, and the like, that are conventionally processed by froth flotation using an acid collector. The selected mineral is screened to provide particles of flotation size according to conventional procedures. Generally, the flotation size will encompass from about 35 to 200 mesh particles.

After the selected mineral has been sized as indicated, it is slurried in aqueous medium and conditioned with an effective amount of the collector combination. Generally, the effective amount will be found in the range of about 0.1 to 2 pounds per ton of ore although variations outside this range may occur due to the specific ore processed, the quantity and nature of gangue material, the particular collector combination being used, the particular values of recovery and grade desired and the like. Phosphate and iron minerals, in general, are floated at a pH value in the range of about 6.0 to 12.0, preferably about 8.0 to 10.0. Suitable additional additives such as pH regulators, frothers, fuel oil, and the like, may be added in conjunction with conventional procedures.

After the slurry has been conditioned as indicated, it is subjected to froth flotation following conventional practice. The desired mineral values are recovered with the froth and the gangue remains behind.

The process of the present invention uses as the mineral collector a combination of about 1 to about 99 weight percent of a fatty acid derived from a vegetable or animal oil and, correspondingly, from about 99 to about 1 weight percent of an alkylamidoalkylaminoalkyl or an alkylamidoalkoxyalkyl monoester of a sulfosuccinic acid of the general formula (I). Illustrative compounds of this formula include:

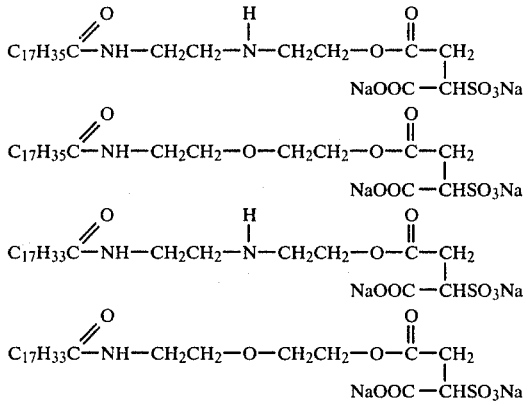

and the corresponding free acids, potassium salts and ammonium salts.

The fatty acid employed in the collector combination is one derived from a vegetable or animal oil. Illustrative vegetable oils include babassu, castor, Chinese tallow, coconut, corn, cottonseed, grapeseed, hempseed, kapok, linseed, wild mustard, oiticica, olive, ouri-ouri, palm, palm kernel, peanut, perilla, poppyseed, Argentine rapeseed, rubberseed, safflower, sesame, soybean, sugarcane, sunflower, tall, teaseed, tung and ucuhuba oils. Animal oils include fish and livestock oils. These oils contain acids ranging from six to twenty-eight carbon atoms or more which may be saturated or unsaturated, hydroxylated or not, linear or cyclic and the like.

A preferred collector combination is one containing about 90 to 97 weight percent of fatty acid and, correspondingly, about 10 to 3 weight percent of the specified monoester of sulfosuccinic acid or salt thereof.

The invention is more fully illustrated in the examples which follow wherein all parts and percentages are by weight unless otherwise specified. Although the invention is illustrated with phosphate rock as typical of phosphate and iron ores, it is to be understood that similar benefits will be obtained with phosphate and iron ores in general. The following general procedure was followed in the froth flotation examples which follow.

GENERAL PROCEDURE

Rougher Float

Step 1

Secure washed and sized feed, e.g., 35×150 mesh screen fractions. Typical feed is usually a mixture of 23% coarse with 77% fine flotation particles.

Step 2

Sufficient wet sample, usually 640 parts, to give a dry weight equivalent of 500 parts. The sample is washed once with about an equal amount of tap water. The water is carefully decanted to avoid loss of solids.

Step 3

The moist sample is conditioned for one minute with approximately 100 cc of water, sufficient caustic as 5–10% aqueous solution to obtain the pH desired (pH 9.5–9.6) a mixture of 50% acid and fuel oil and additional fuel oil as necessary. Additional water may be necessary to give the mixture the consistency of "oatmeal" (about 69% solids). The amount of caustic will vary from 4 to about 20 drops. This is adjusted with a pH meter for the correct endpoint. At the end of the conditioning, additional caustic may be added to adjust the endpoint. However, an additional 15 seconds of conditioning is required if additional caustic is added to adjust the pH. Five to about 200 drops of acid-oil mixture and one-half this amount of additional oil is used, depending on the treatment level desired.

Step 4

Conditioned pulp is placed in an 800-gram bowl of a flotation machine and approximately 2.6 liters of water are added (enough water to bring the pulp level to lip of the container). The percent solids in the cell is then about 14%. The pulp is floated for 2 minutes with air introduced after 10 seconds of mixing. The excess water is carefully decanted from the rougher products. The tails are set aside for drying and analysis.

Step 5

The products are oven dried, weighed, and analyzed for weight percent $P_2O_5$ or BPL. Recovery of mineral values is calculated using the formula:

$$\frac{(W_c) \times (P_c)}{(W_c) \times (P_c) + (w_t) \times (P_t)} \times 100$$

wherein $W_c$ and $W_t$ are the dry weights of the concentrate and tailings, respectively, and $P_c$ and $P_t$ are the weight percent $P_2O_5$ or BPL of the concentrate or tails, respectively.

EXAMPLE 1

Following the general procedure, Florida pebble phosphate rock was froth floated following conventional procedures using a fatty acid derived from tall oil in conjunction with No. 5 fuel oil at pH 9.0 as a control standard. As an example of the invention, a collector combination consisting of 92% of tall oil fatty acid and 8% of a sulfosuccinate of the structure:

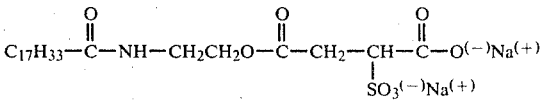

was employed in conjunction with fuel oil. Results and test details are given in Table I.

TABLE I

FLOTATION OF PHOSPHATE ROCK

| Example | Dosages Fatty Acid (lbs/ton) | Additive (lbs/ton) | Fuel Oil (lbs/ton) | Weight Recovery (%) | % BPL Feed | Tail | Conc. | BPL Recovery (%) | Improvement Over Fatty Acid (%) |
|---|---|---|---|---|---|---|---|---|---|
| Comparative | 0.44 | — | 0.44 | 13.65 | 18.64 | 10.93 | 67.45 | 49.38 | — |
| 1 | 0.405 | 0.035 | 0.44 | 17.98 | 17.89 | 6.78 | 68.58 | 68.92 | 39.6 |

EXAMPLES 2–5

Following the general procedure outlined above, Florida pebble phosphate rock was froth floated following conventional procedures using a collector combination consisting of 90% tall oil fatty acid and 10% of an alkylaminoalkyl monoester of a sulfosuccinate of the structure:

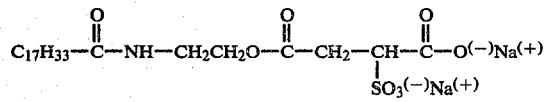

was employed in conjunction with fuel oil. Results and details are given in Table II along with comparative examples.

TABLE II

FLOTATION OF PHOSPHATE ROCK

| Example | Ratio* | Collector Dosage (lbs./ton) | Fuel Oil Dosage (lbs./ton) | Weight Recovery | Assay % BPL Feed | Tail | Conc. | BPL Recovery % |
|---|---|---|---|---|---|---|---|---|
| Comp. A | 100/0 | 0.3 | 0.6 | 0.08 | 14.31 | 14.30 | 22.32 | 0.12 |
| 2 | 90/10 | 0.3 | 0.6 | 18.31 | 15.09 | 4.6 | 61.89 | 75.10 |
| Comp. B | 100/0 | 0.4 | 0.8 | 4.41 | 14.66 | 12.70 | 57.19 | 17.20 |
| Comp. C | 100/0 | 0.4 | 0.8 | 6.15 | 13.33 | 10.32 | 59.21 | 27.32 |
| 3 | 90/10 | 0.4 | 0.8 | 21.15 | 15.70 | 3.53 | 61.08 | 82.27 |
| Comp. D | 100/0 | 0.5 | 1.0 | 18.89 | 15.28 | 7.18 | 50.07 | 61.89 |
| 4 | 90/10 | 0.5 | 1.0 | 19.82 | 14.99 | 3.31 | 62.26 | 82.30 |
| Comp. E | 100/0 | 1.0 | 2.0 | 25.06 | 15.58 | 2.82 | 53.72 | 86.43 |
| 5 | 90/10 | 1.0 | 2.0 | 23.03 | 14.60 | 1.79 | 57.41 | 90.56 |

*Weight percent of fatty acid to alkylamino monoester of sulfosuccinate.

EXAMPLE 7

Following the procedure of Examples 2–5 in every material detail except that an alkylaminoalkyl monoester of a sulfosuccinate of the structure:

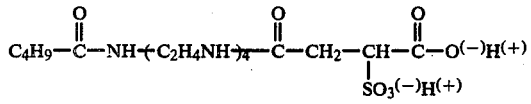

was employed, substantially equivalent results were obtained.

EXAMPLE 8

Following the procedure of Examples 2–5 in every material detail except than an alkylaminoalkyl monoester of a sulfosuccinate of the structure:

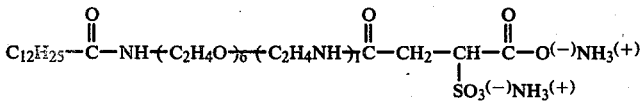

was employed, substantially equivalent results were obtained.

EXAMPLE 9

Following the procedure of Examples 2–5 in every material detail except that an alkylaminoalkyl monoester of a sulfosuccinate of the structure:

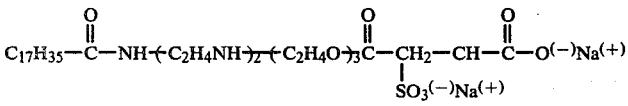

was employed, substantially equivalent results were obtained.

EXAMPLES 10–13

The procedure of Examples 2–5 is followed in every material detail except that the ratio of the fatty acid to the alkylamino monoester of the sulfosuccinate is varied to show more clearly the synergistic effect.

Results and details are given in Table III.

TABLE III

FLOTATION OF PHOSPHATE ROCK

| Example | Ratio* | Collector Dosage (lb./ton) | Fuel Oil Dosage (lbs./ton) | Weight Recovery | Assay % BPL Feed | Tail | Conc. | % BPL Recovery |
|---|---|---|---|---|---|---|---|---|
| 10 | 100/0 | 0.5 | 1.0 | 18.89 | 15.28 | 7.18 | 50.07 | 61.89 |
| 11 | 90/10 | 0.5 | 1.0 | 19.82 | 14.99 | 3.31 | 62.26 | 82.30 |
| 12 | 50/50 | 0.5 | 1.0 | 23.72 | 15.03 | 1.46 | 57.22 | 90.30 |
| 13 | 0/100 | 0.5 | 1.0 | 22.15 | 15.09 | 2.85 | 55.23 | 81.08 |

*Weight percent of fatty acid to alkylamino monoester of a sulfosuccinate.

We claim:

1. A process for beneficiating phosphate and iron ores which comprises classifying the mineral to provide particles of flotation size, slurrying the classified mineral in aqueous medium, conditioning the slurry with an effective amount of a collector combination and froth floating the desired mineral values, said collector combination comprising from about 1 to 99 weight percent of a fatty acid derived from a vegetable or animal oil and, correspondingly, from about 99 to 1 weight percent of an alkylamidoalkylaminoalkyl or alkylamidoalkoxyalkyl monoester of a sulfosuccinic acid of the general formula:

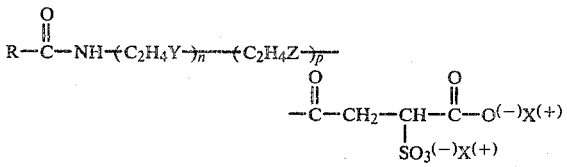

wherein R is a saturated or unsaturated alkyl radical of about 4 to 18 carbon atoms, Y is —NH— or —O—, n is an integer of from 1 to 10 inclusive, Z is —NH— or —O—, p is an integer of from 0 to 9 inclusive such that the sum (n+p) never has a value greater than 10, and X is hydrogen, alkali metal ion or ammonium ion.

2. The process of claim 1 wherein said alkylamidoalkoxyalkyl monoester of sulfosuccinic acid has the structure:

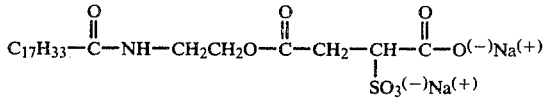

3. The process of claim 1 wherein said fatty acid is derived from tall oil.

4. The process of claim 1 wherein said fatty acid is derived from tall oil and said alkylamidoalkoxyalkyl monoester of sulfosuccinic acid has the structure:

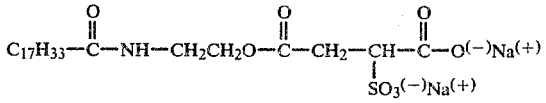

* * * * *